US007448908B2

(12) United States Patent
Iwahori et al.

(10) Patent No.: US 7,448,908 B2
(45) Date of Patent: Nov. 11, 2008

(54) WATERPROOF CONNECTOR

(75) Inventors: Yoshihiro Iwahori, Shizuoka-ken (JP); Mitsuo Akiyama, Shizuoka-ken (JP); Hiroshi Miyazaki, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/702,181

(22) Filed: Feb. 5, 2007

(65) Prior Publication Data

US 2007/0197069 A1 Aug. 23, 2007

(30) Foreign Application Priority Data

Feb. 20, 2006 (JP) ..... 2006-042757

(51) Int. Cl.
*H01R 13/40* (2006.01)

(52) U.S. Cl. ..... 439/587; 439/701

(58) Field of Classification Search ..... 439/271, 439/272, 587, 701
See application file for complete search history.

(56) References Cited

U.S. PATENT DOCUMENTS 5,266,045 A * 11/1993 Yamamoto et al. ..... 439/275
6,254,431 B1 * 7/2001 Murakami et al. ..... 439/587
6,494,731 B1 * 12/2002 Suzuki ..... 439/275
6,517,368 B2 * 2/2003 Hara et al. ..... 439/271
6,527,586 B2 * 3/2003 Okamura et al. ..... 439/587
6,599,153 B2 * 7/2003 Nishide ..... 439/681
6,672,900 B2 * 1/2004 France et al. ..... 439/587
6,752,659 B2 * 6/2004 Nakamura et al. ..... 439/275

FOREIGN PATENT DOCUMENTS

JP 2002-110289 4/2002

* cited by examiner

*Primary Examiner*—Thanh-Tam T Le
(74) *Attorney, Agent, or Firm*—Finnegan, Henderson, Farabow, Garrett & Dunner, L.L.P.

(57) ABSTRACT

A waterproof connecter is provided with a frame including a plurality of accommodating rooms, a plurality of sub-connectors accommodated in the accommodating rooms, respectively, and gaskets for sealing gaps between the sub-connectors and the accommodating rooms, respectively. A side surface of each of the sub-connectors is provided with a sealing surface which comes into close contact with each of the gaskets. Each of the gaskets is provided with engagement projections, and engagement holes which correspond to the engagement projections are provided in an inner wall of each of the accommodating rooms of the frame. By allowing the engagement projections to be engaged with the engagement holes, the gaskets are fixed to the inner walls of the accommodating rooms.

3 Claims, 13 Drawing Sheets

WATERPROOF CONNECTOR

CROSS REFERENCE TO RELATED APPLICATION

This application claims benefit of priority under 35 USC 119 based on Japanese Patent Application P2006-042757 filed Feb. 20, 2006, the entire contents of which are incorporated by reference herein.

BACKGROUND OF THE INVENTION

1. Field of the Invention

Present invention relates to a divided-type waterproof connector which is constructed by incorporating a plurality of sub-connectors into a frame.

2. Description of the Related Art

As a conventional waterproof connector structured by a plurality of sub-connectors, there is a known example disclosed in Japanese Patent Laid-Open Publication 2002-110289 in which a plurality of sub-connectors is incorporated into a single frame, and gaps between the plurality of sub-connectors and the frame are sealed by sealing members.

FIG. 1 is a cross-sectional view illustrating a waterproof connector stated in the Japanese Patent Laid-Open Publication above, and FIG. 2 is an exploded perspective view illustrating structures of a sub-connector, a sealing member, and so forth.

The waterproof connector depicted in FIGS. 1 and 2 includes a frame 110 which is provided with a plurality of accommodating rooms 111A and 111B, a plurality of sub-connectors 120 which is accommodated into the accommodating rooms 111A and 111B, respectively, rubber stoppers 130 each of which seals a gap between each of the sub-connectors 120 and the accommodating room 111A or 111B and also concurrently seals gaps between electric wires 151 connected to the terminals 150 accommodated in the sub-connectors 120 and the housing 121 of the sub-connector 120, and a cover 140 which presses the rubber stopper 130 to prevent the rubber stopper 130 from falling. Locking portions 115 and 125 are provided in the accommodating rooms 111A and 111B and in the sub-connectors 120, respectively. On the outer circumference of each of the rubber stopper 130, sealing lips 131 are provided.

When the sub-connectors 120 are inserted into the accommodating rooms 111A and 111B, the locking portions 115 and 125 are engaged with each other, and the sealing lips 131 come into close contact with the inner walls of the accommodating rooms 111A and 111B. Therefore, the gaps between the sub-connectors 120 and the accommodating rooms 111A and 111B are sealed.

In this conventional waterproof connector, the sealing lips 131 on the outer circumferences of the rubber stoppers 130 serve as gaskets which seal the gaps between the sub-connectors 120 and the accommodating rooms 111A and 111B. However, since the sealing lips 131 are exposed to the outside before the sub-connectors 120 are fitted into the accommodating rooms 111A and 111B of the frame 110, the sealing lips 131 are contaminated by dirt or dust, or scratched easily. As a result, the quality could be deteriorated. In order to prevent this, use of protection covers for the sub-connectors 120 can be considered, which however causes a problem of a cost increase due to an increase in the number of parts.

SUMMARY OF THE INVENTION

In the light of the above-described problems, an objective of the present invention is to provide a waterproof connector which prevents gaskets which seal gaps between sub-connectors and frame from being contaminated by dirt or dust, scratched or the like, so that waterproof property thereof is enhanced without increasing the number of parts and costs.

An aspect of the present invention is to provide a waterproof connector which comprises a frame including a plurality of accommodating rooms, a plurality of sub-connectors to be accommodated in the accommodating rooms, respectively, and gaskets for sealing gaps between the sub-connectors and the accommodating rooms, wherein the gaskets are fixed to inner walls of the accommodating rooms, and sealing surfaces are provided on outer circumferences of the sub-connectors so that sealability is obtained by pressing the sealing surfaces against inner circumferences of the gaskets.

According to the above construction, the gaskets which seal gaps between the sub-connectors and the frame can be provided within the frame in advance, preventing the gaskets from being contaminated by dirt or dust, or scratched before the sub-connectors are incorporated to the frame. Therefore, waterproof property is improved. In addition, since no protection covers for the gaskets are required, an increase in the number of parts or costs is unlikely.

In addition to the foregoing construction, engagement projections may be provided in either the gaskets or the inner walls of the accommodating rooms, engagement holes may be provided in opposite gaskets or inner walls of the accommodating rooms, and the gaskets may be fixed to the inner walls of the accommodating rooms by allowing the engagement projections to be engaged with the engagement holes.

According to the above construction, since the gaskets are fixed to the inner walls of the accommodating rooms, the gaskets are prevented from falling before the sub-connectors are fitted into the frame.

In addition to the aforementioned construction, protection walls may be provided in the sub-connectors for protecting the gaskets by sealing inlets of the accommodating rooms when the sub-connectors are accommodated into the accommodating rooms.

According to the above construction, the gaskets are protected from contamination by dirt or dust from without in a state where the sub-connectors are fitted into the accommodating rooms. Hence, the waterproof property of the gaskets can be improved. Moreover, since the protection walls can prevent the gaskets from moving, it becomes possible to ensure the gaskets are fixed more firmly. In addition, no gasket caps need to be added, and an increase in the number of parts can be avoided.

Furthermore, in addition to the foregoing construction, locking portions may be provided in the frame and the sub-connectors for locking the frame and the sub-connectors to each other when the sub-connectors are accommodated into the accommodating rooms, and the locking portion on the side of the frame projects further than an end portion of the frame, and may be bent in a direction perpendicular to a direction in which the sub-connectors are inserted into the frame.

According to the foregoing construction, the sub-connectors can be attached/detached easily, and operability is improved.

In addition to the foregoing construction, the locking portions on the side of the sub-connectors may be provided on rear sides of waterproof rubber stoppers to be inserted into rear ends of terminal accommodating rooms of the sub-connectors, respectively.

According to the foregoing construction, the shape of areas surrounding the locking projections can be designed freely without any limits by the areas where the waterproof rubber stoppers are fitted.

DESCRIPTION OF THE EMBODIMENT

An embodiment of a waterproof connector according to the present invention is descried below.

Figure 1:
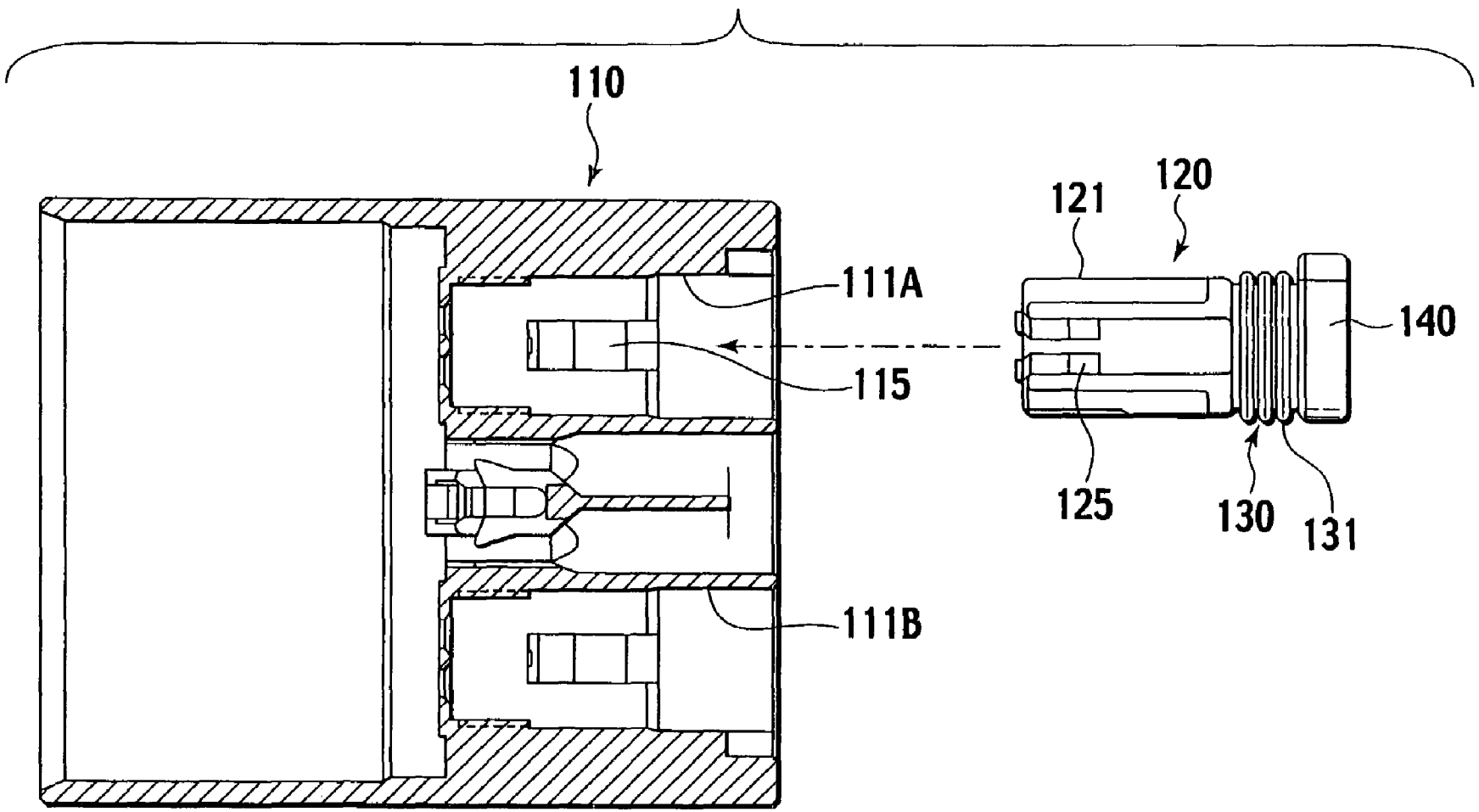
FIG. 1 PRIOR ART
FIG. 1 is a cross-sectional view of a conventional waterproof connector.
Figure 2:
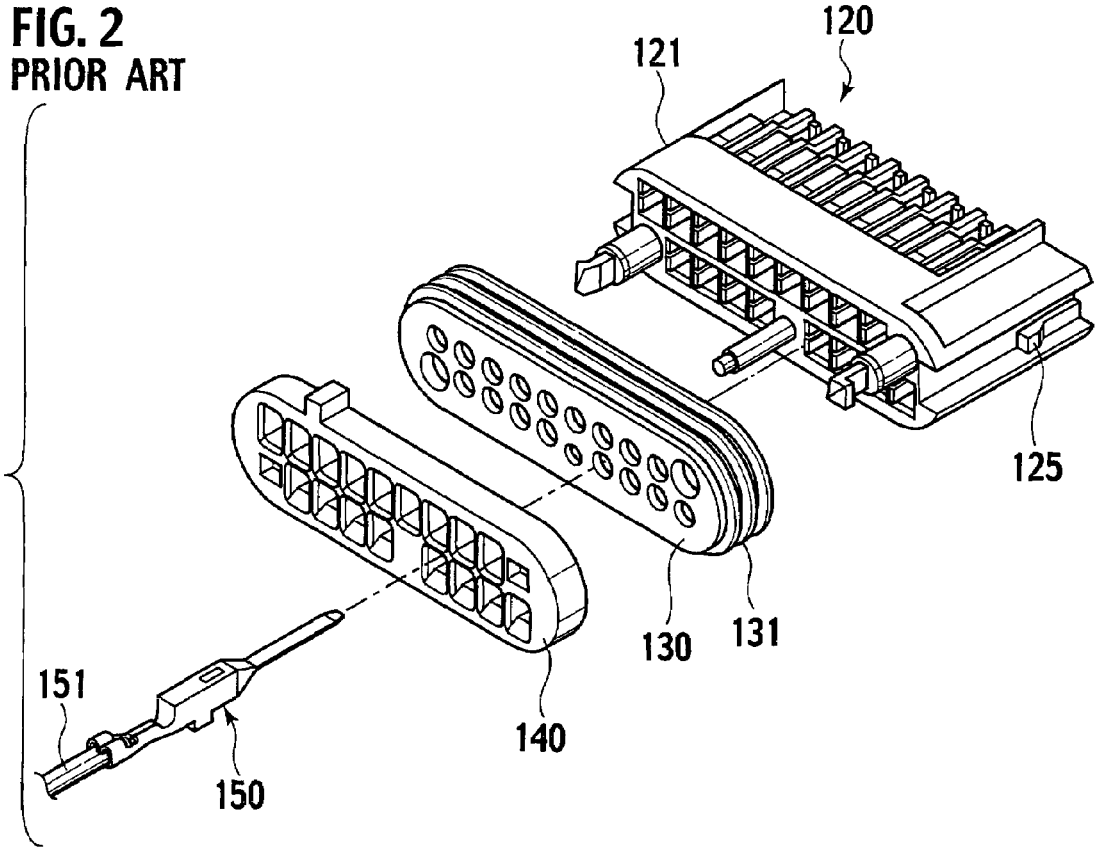
FIG. 2 PRIOR ART
FIG. 2 is an exploded perspective view of a sub-connector in FIG. 1.
Figure 3:
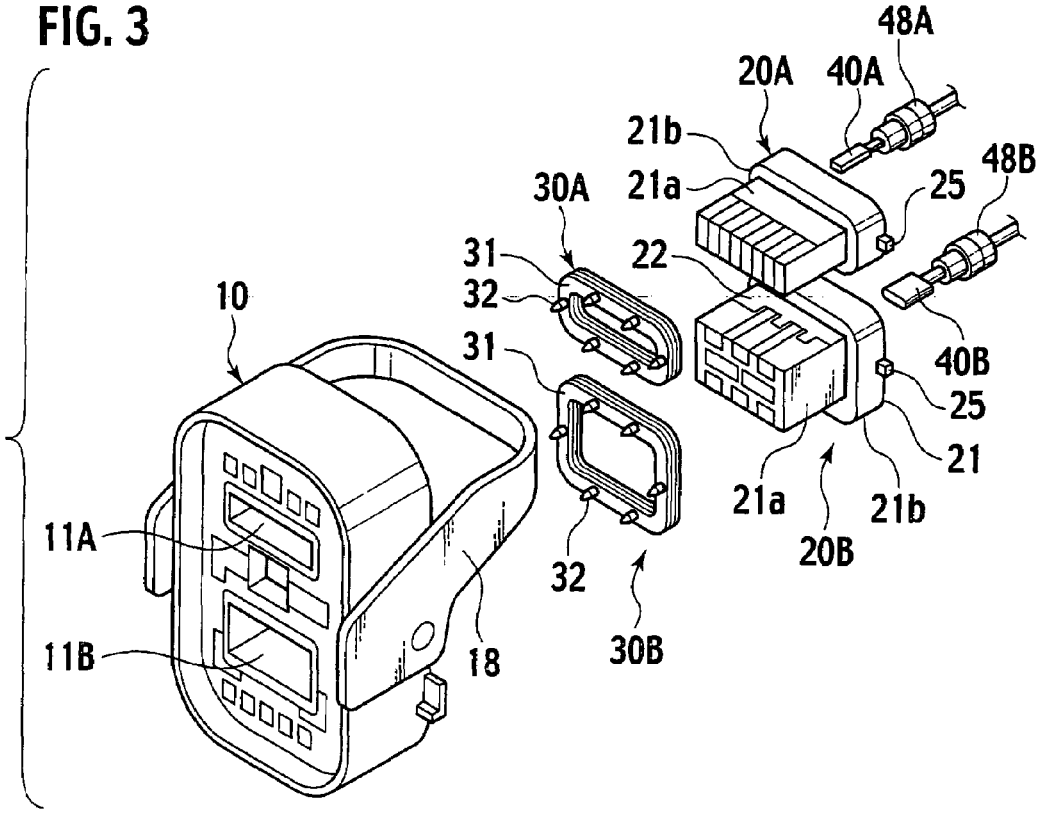
FIG. 3 is an exploded perspective view of a waterproof connector according to an embodiment of the present invention.
Figure 14:
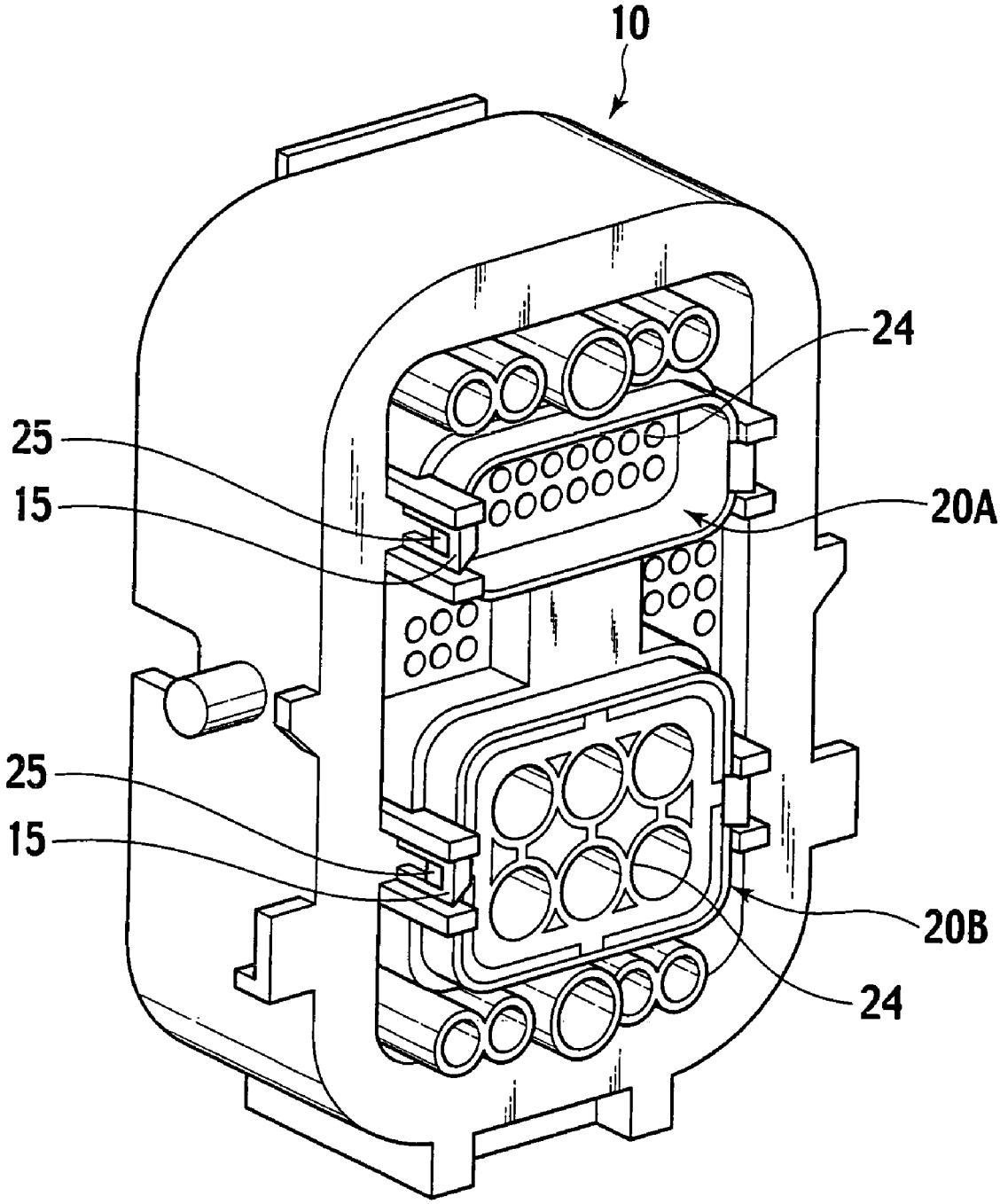
FIG. 14 is a perspective back view showing a state where the sub-connectors are fitted into accommodating rooms of the frame, respectively.

According to FIGS. 3 to 10, this waterproof connector is provided with a frame 10 including a plurality of accommodating rooms 11A and 11B (the number of accommodating rooms is not limited to two as shown in the illustrated example, and may be two or more.), a plurality of sub-connectors 20A and 20B (either male or female) accommodated in the accommodating rooms 11A and 11B, respectively, and gaskets 30A and 30B for sealing gaps between the sub-connectors 20A and 20B and the accommodating rooms 11A and 11B. As shown in FIG. 3, terminals 40A and 40B are inserted into terminal accommodating rooms 24 (see FIG. 14) formed in housings 21 of the sub-connectors 20A and 20B, respectively, from the back, and rubber stoppers 48A and 48B are attached to electric wires which extend backward from the terminals 40A and 40B, respectively, sealing gaps between terminal accommodating rooms 24 and the electric wires.

Figure 4:
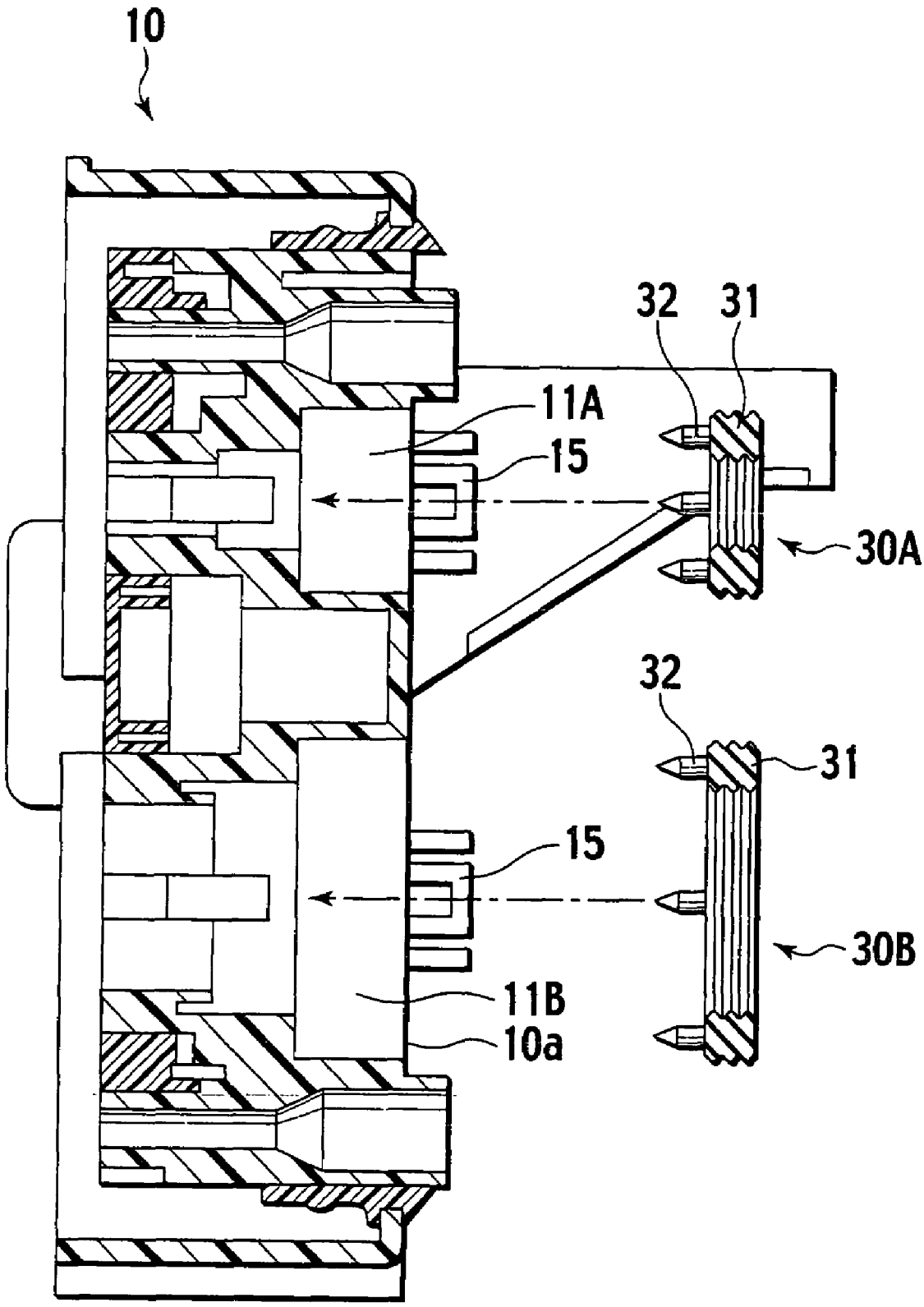
FIG. 4 is a cross-sectional view showing a state before gaskets are inserted into accommodating rooms of a frame, respectively.
Figure 5:
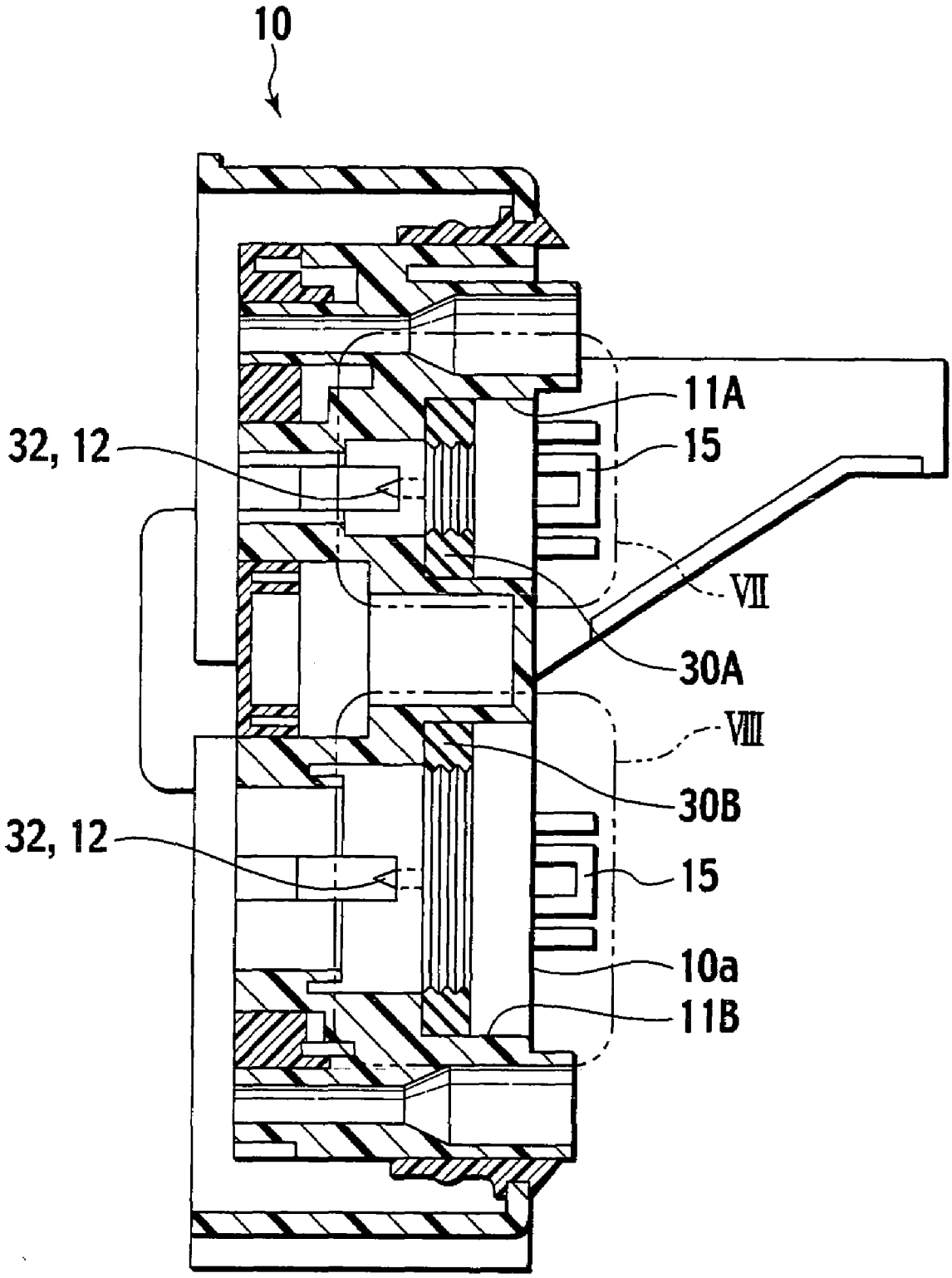
FIG. 5 is a cross-sectional view showing a state where the gaskets are inserted into the accommodating rooms of the frame, respectively.
Figure 6:
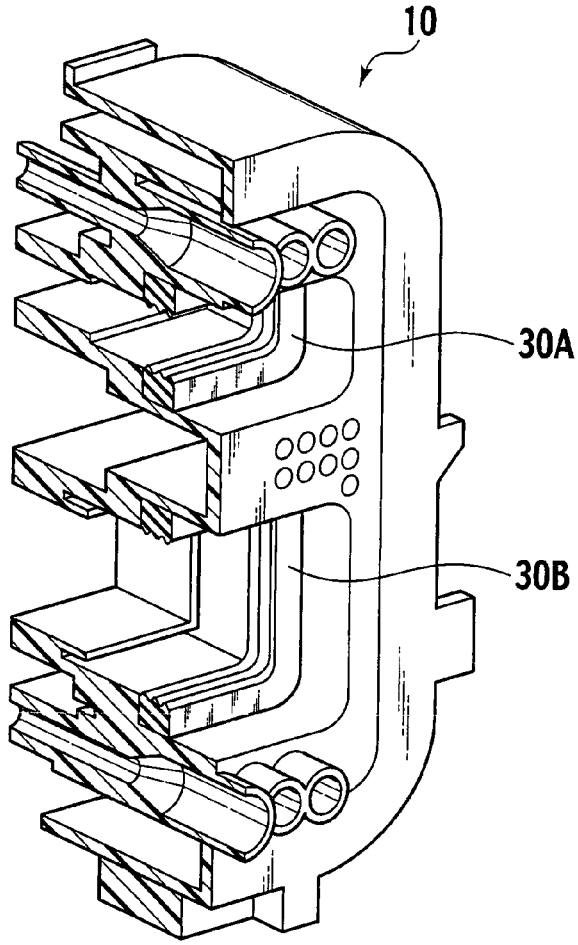
FIG. 6 is a broken perspective view showing the same state as FIG. 5.
Figure 7:
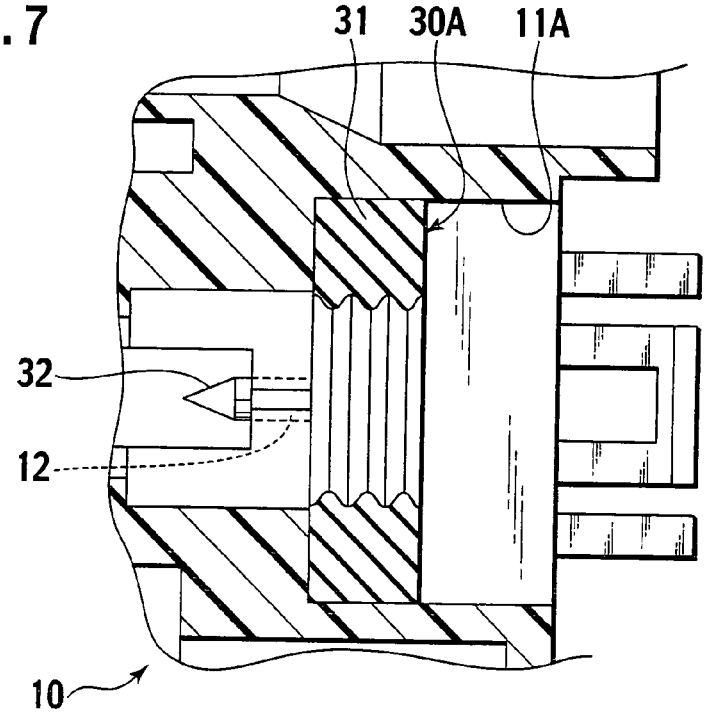
FIG. 7 is an enlarged view of the VII area in FIG. 5.
Figure 8:
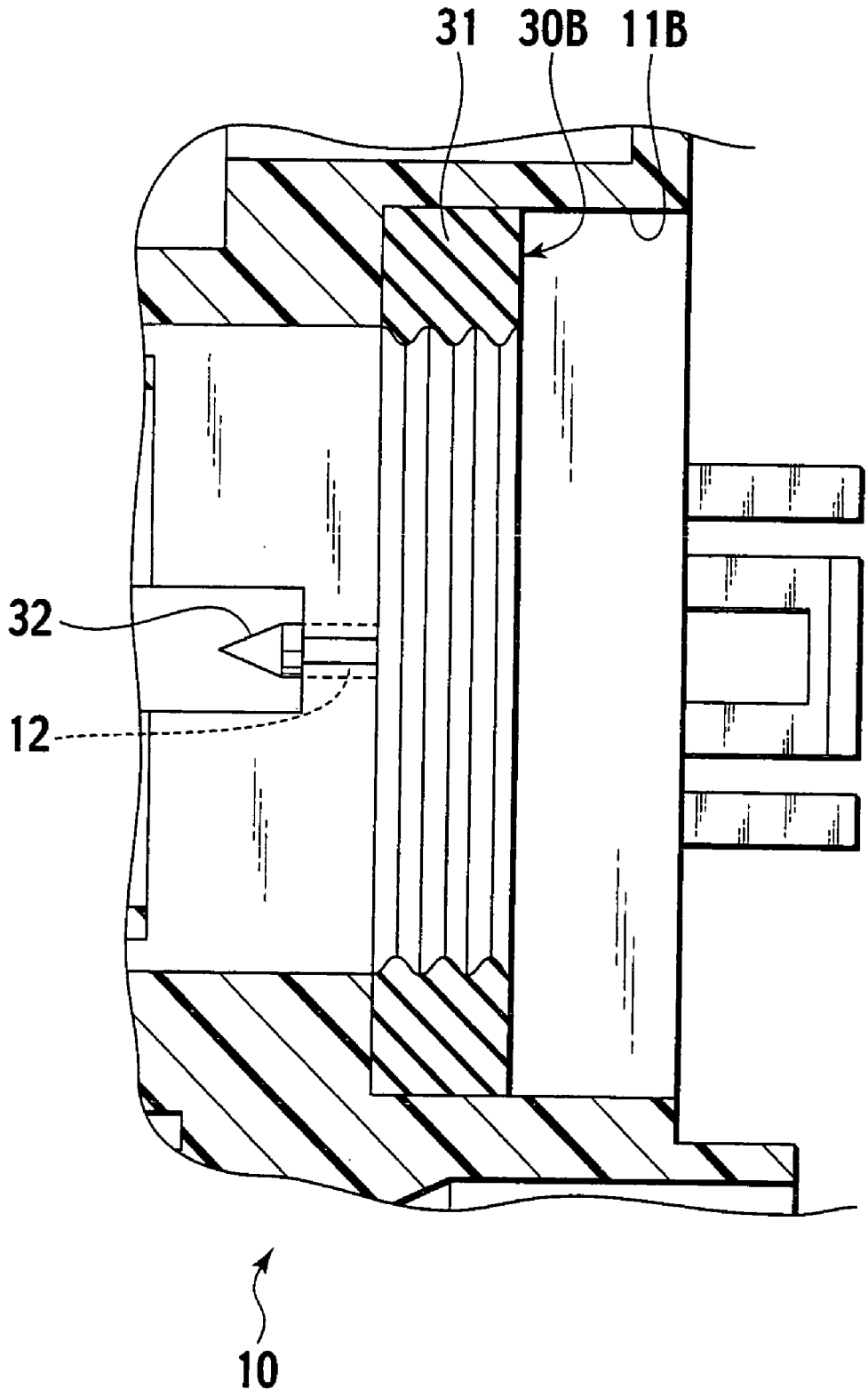
FIG. 8 is an enlarged view of the VIII area in FIG. 5.
Figure 9:
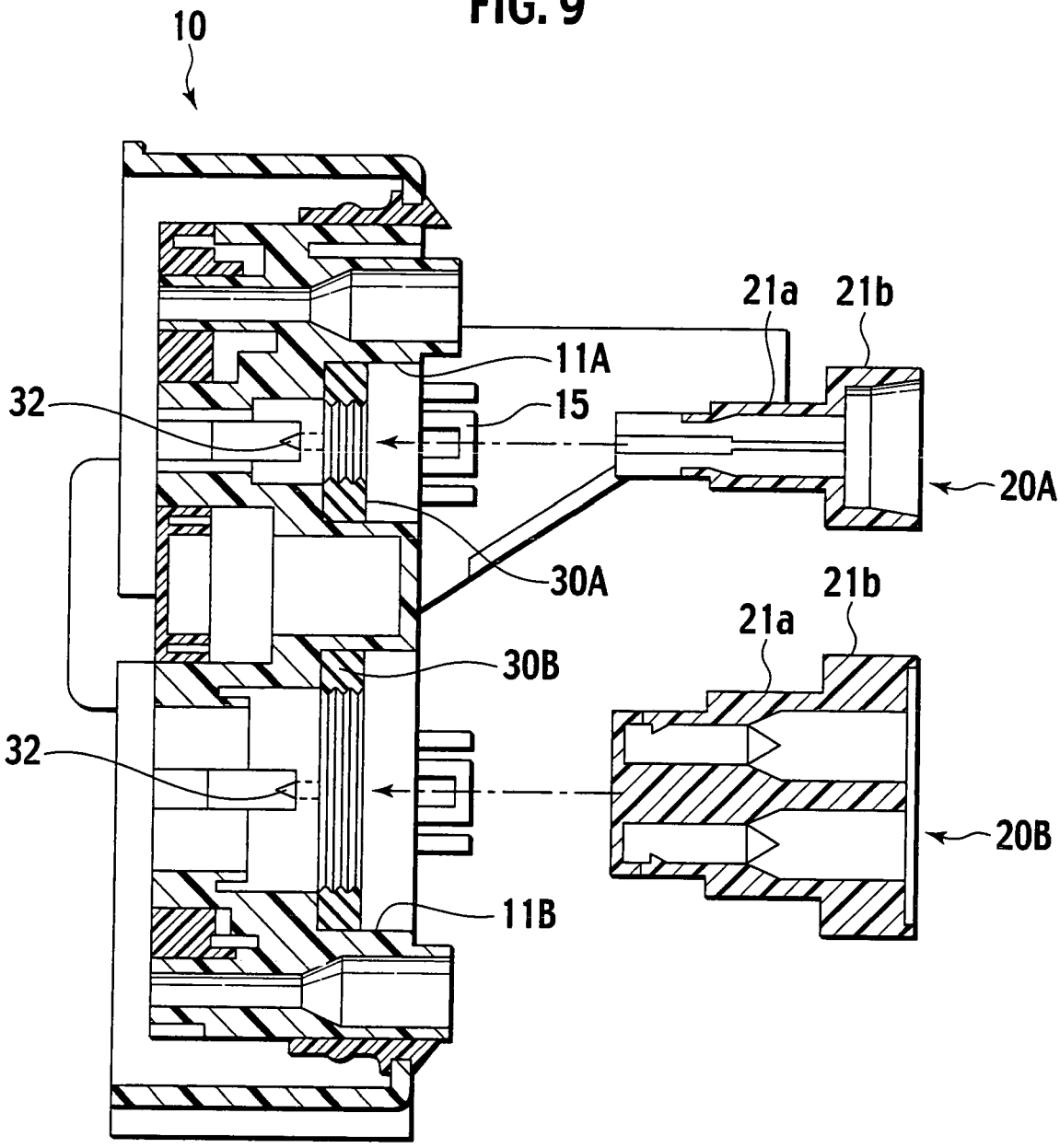
FIG. 9 is a cross-sectional view showing a state before the sub-connectors are fitted into the accommodating rooms of the frame, respectively.
Figure 10:
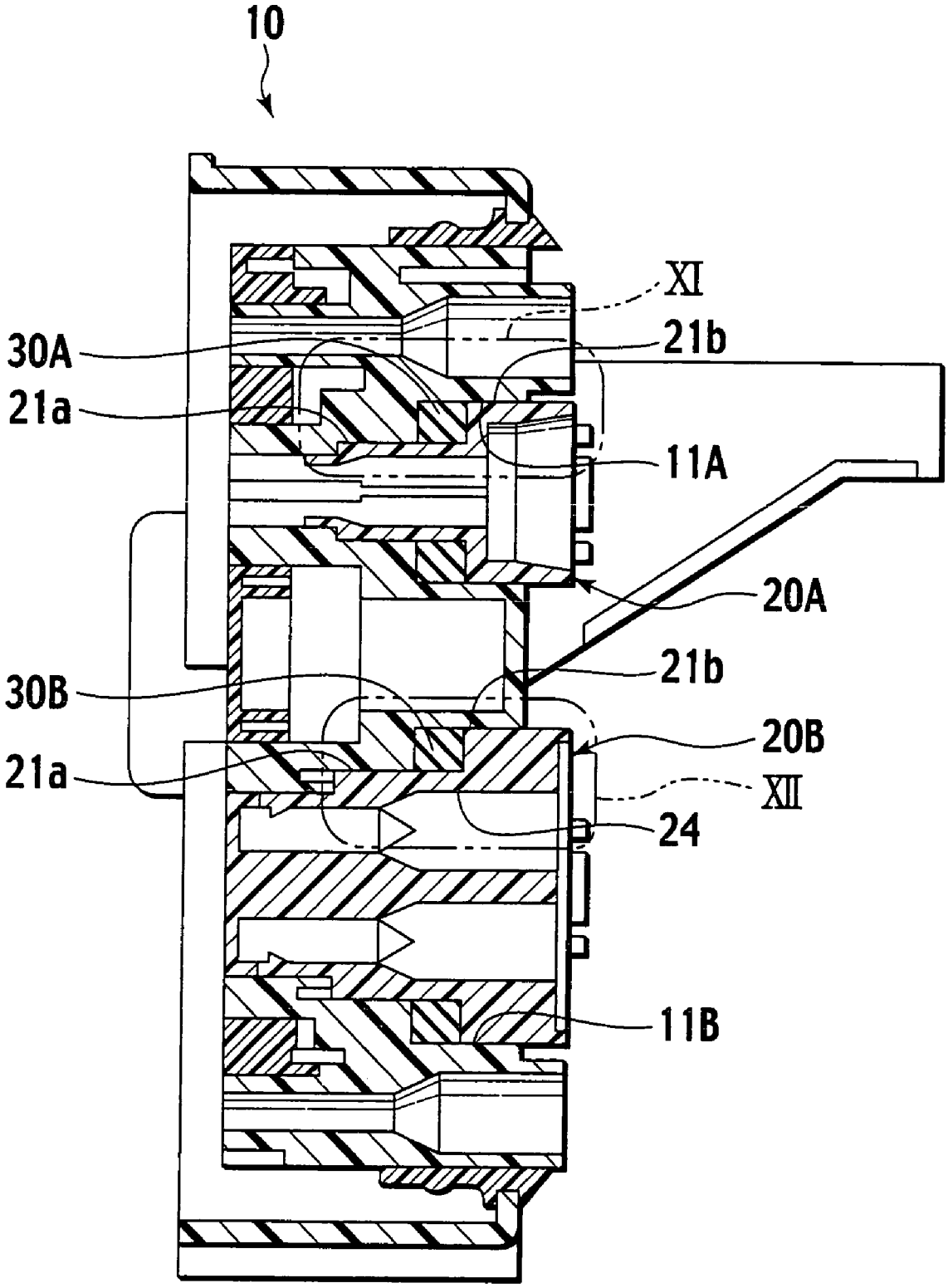
FIG. 10 is a cross-sectional view showing a state where the sub-connectors are fitted into the accommodating rooms of the frame, respectively.
Figure 11:
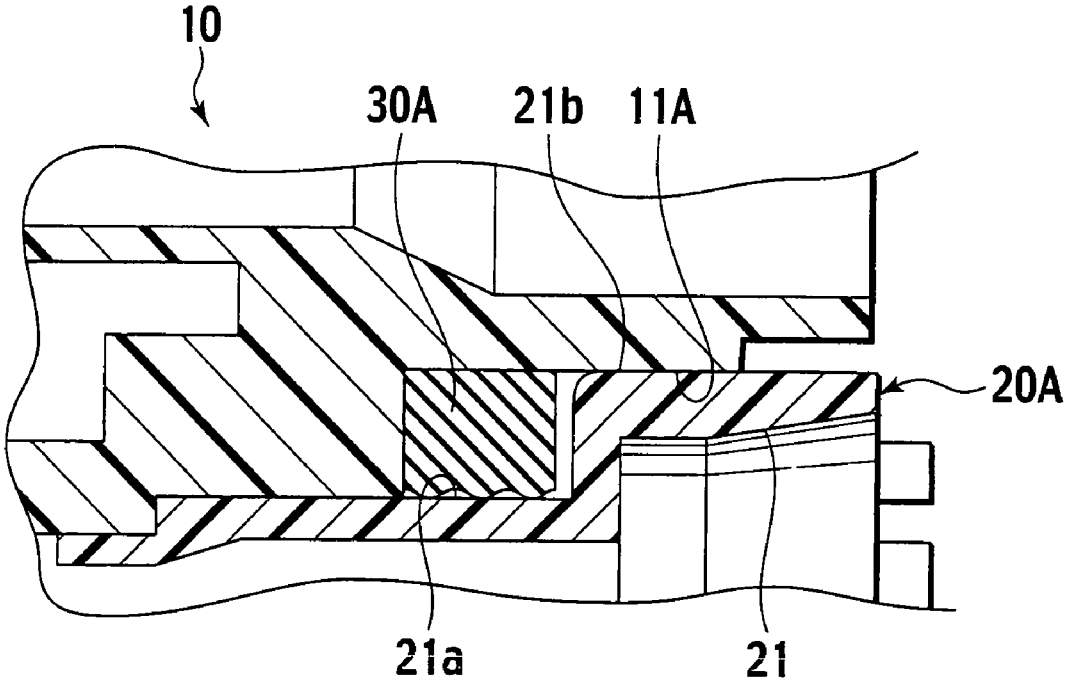
FIG. 11 is an enlarged view of the XI area of FIG. 10.
Figure 12:
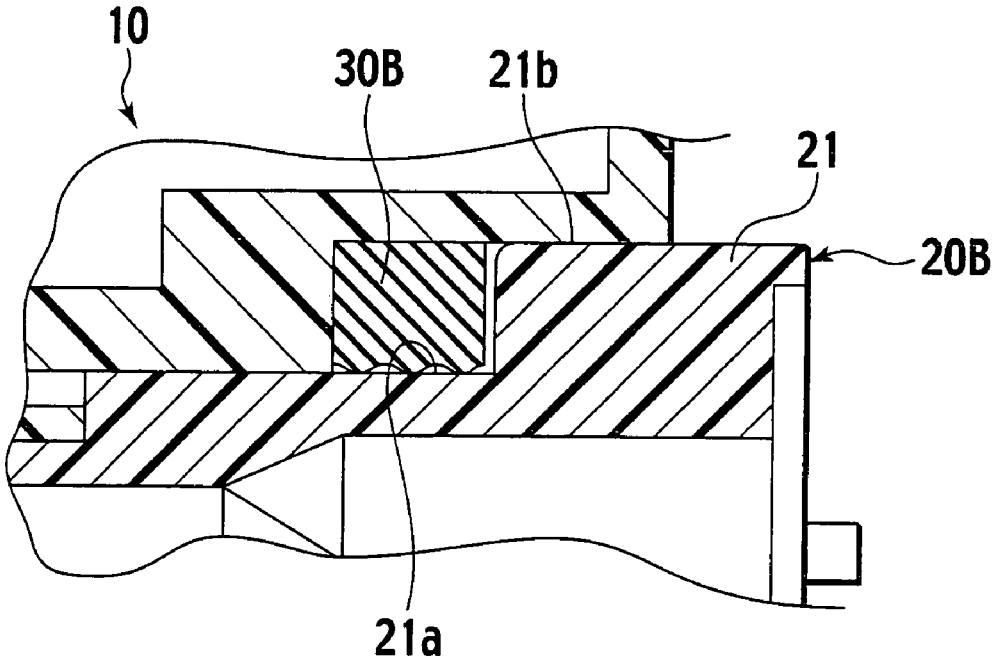
FIG. 12 is an enlarged view of the XII area of FIG. 10.
Figure 13:
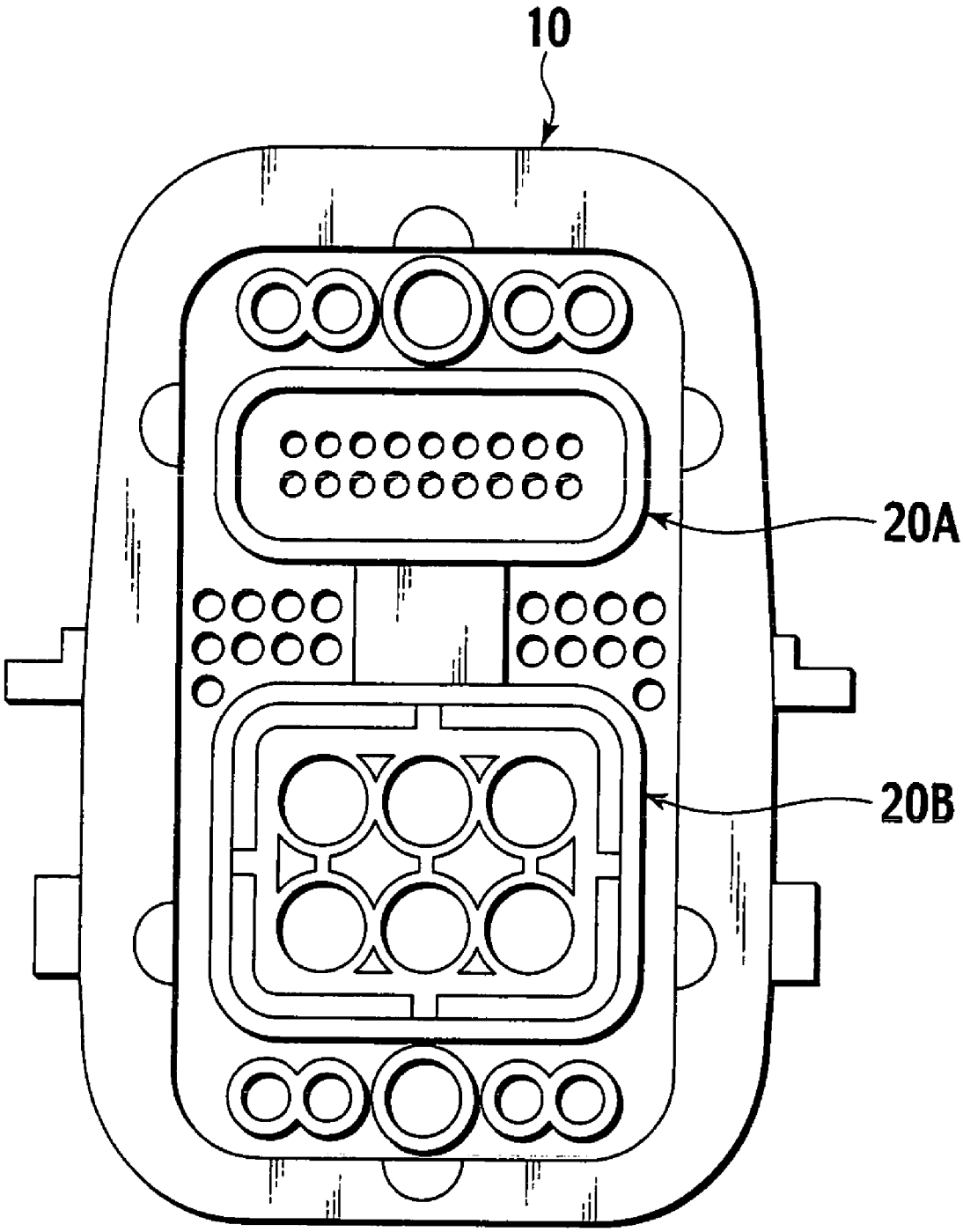
FIG. 13 is a back surface view showing a state where the sub-connectors are fitted into the accommodating rooms of the frame, respectively.

As shown in FIGS. 3 and 4, each of the gaskets 30A and 30B includes a ring-shaped gasket body 31 with sealing lips (no particular reference numerals are designated) provided in outer and inner circumferences thereof, and a plurality of engagement projections 32 provided on the front end surface of the gasket body 31. As shown in FIGS. 7 and 8, engagement holes 12 are formed in the inner wall of each of the accommodating rooms 11A and 11B, and, by allowing the engagement holes 12 to be engaged with the engagement projections 32 on each gasket, respectively, the gaskets are fixed to the inner circumference walls of the accommodating rooms 11A and 11B, respectively.

As illustrated in FIGS. 9 to 13, the housing 21 of each of the sub-connectors 20A and 20B is provided with a sealing surface 21*a* on its outer circumference. When the sub-connectors 20A and 20B are fitted to the accommodating rooms 11A and 11B, the sealing surfaces 21*a* are pressed against the inner circumferences of the gaskets 30A and 30B, obtaining sealability. Moreover, protection walls 21*b* are formed on the rear side of the sealing surfaces 21*a*, projecting further than the sealing surfaces 21*a*. The protection walls 21*b* protect the gaskets 30A and 30B by sealing the inlets (rear openings) of the accommodating rooms 11A and 11B when the sub-connectors 20A and 20B are accommodated into the accommodating rooms 11A and 11B.

Figure 15:
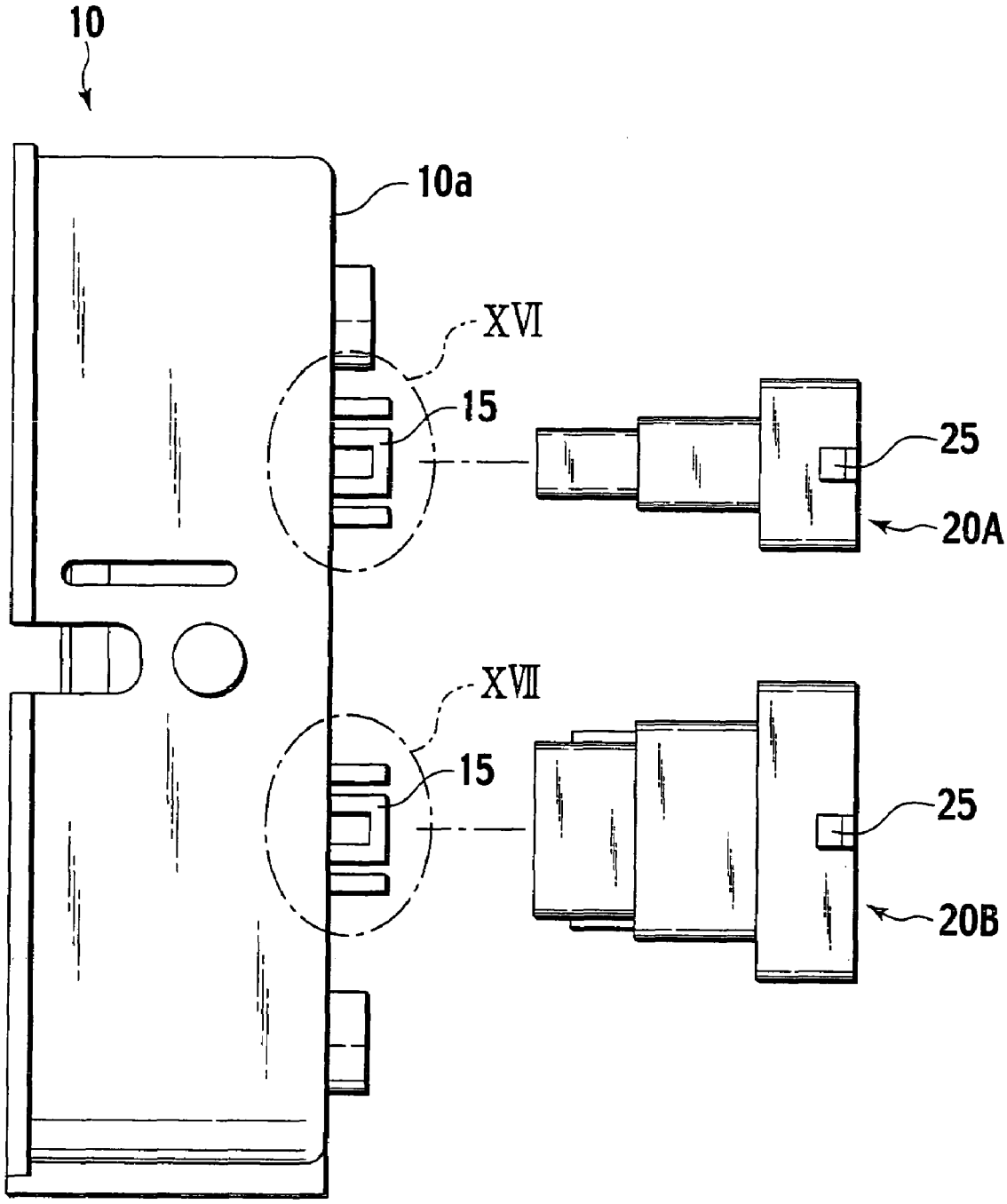
FIG. 15 is an external side view showing a state before the sub-connectors are incorporated into the frame.
Figure 16:
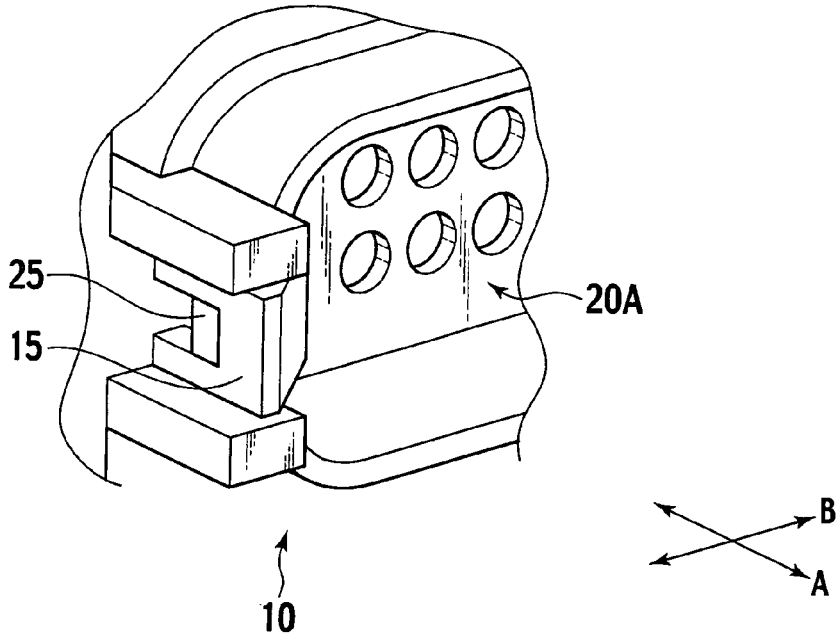
FIG. 16 is an enlarged view showing the XVI area in FIG. 15 in an engaged state.
Figure 17:
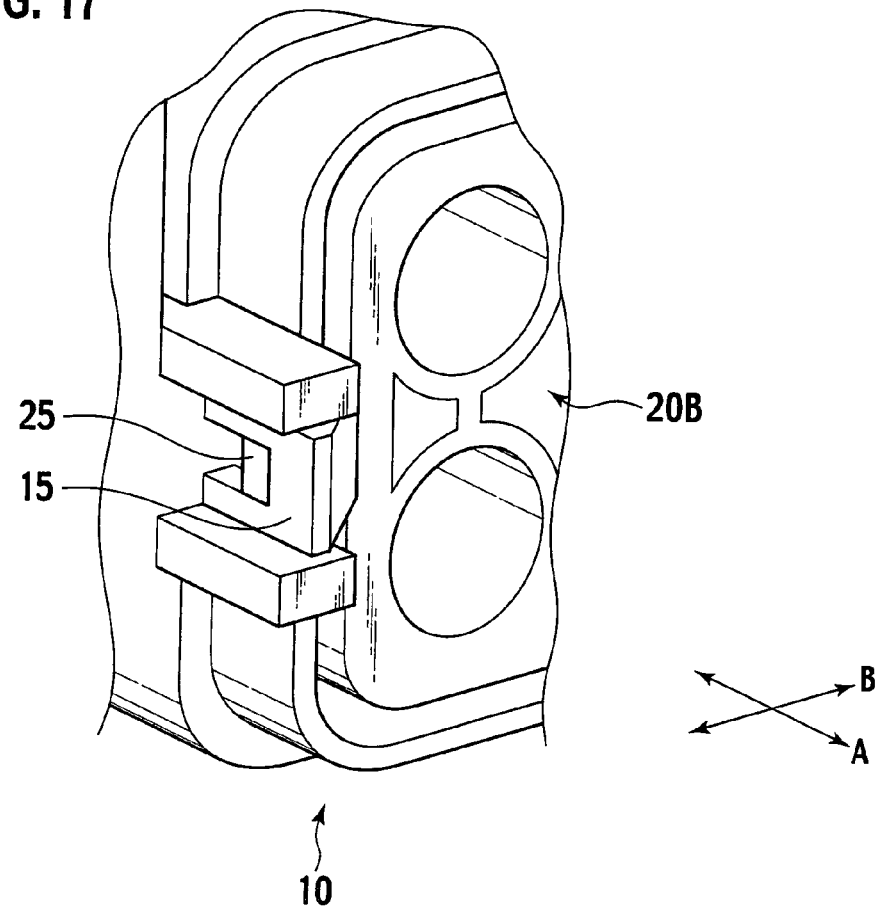
FIG. 17 is an enlarged view showing the XVII area in FIG. 15 in an engaged state.

Further, as shown in FIGS. 14 to 17, locking frames 15 and locking projections 25 (locking portions) are provided in the frame 10 and the sub-connectors 20A and 20B, respectively. When the sub-connectors 20A and 20B are accommodated into and engaged with the accommodating rooms 11A and 11B, the frame 10 and the sub-connectors 20A and 20B are locked to each other. As depicted in FIGS. 15 and 16, the locking frame 15 on the side of the frame 10 projects further behind an rear end 10*a* (end portion) of the frame 10, and can bend in direction B which is perpendicular to a direction A in which the sub-connectors 20A and 20B are inserted. Moreover, the engagement projections 25 of the sub-connectors 20A and 20B are provided on the rear side of the waterproof rubber stoppers 48A and 48B (see FIG. 3) to be inserted to the rear ends of the terminal accommodating rooms 24 of the sub-connectors 20A and 20B.

In the waterproof connector having the above-described construction, the gaskets 30A and 30B which seal gaps between the sub-connectors 20A and 20B and the frame 10 are provided within the frame 10 in advance, unlike the conventional waterproof connector where the gaskets are attached to the sub-connectors 20A and 20B in an exposed manner. Therefore, it becomes possible to prevent the gaskets 30A and 30B from being contaminated by dirt or dust, or scratched before the sub-connectors 20A and 20B are incorporated to the frame 10, thus enhancing waterproof property.

Furthermore, the engagement projections 32 are provided in either the gaskets 30A and 30B or the inner walls of the accommodating rooms 11A and 11B, and the engagement holes 12 are provided in opposite gaskets 30A and 30B or inner walls of the accommodating rooms 11A and 11B. By allowing the engagement projections 32 and the engagement holes 12 to be engaged with each other, the gaskets 30A and 30B are fixed into the inner walls of the accommodating rooms 11A and 11B. Therefore, the gaskets 30A and 30B do not fall before the sub-connectors 20A and 20B are fitted into the frame 10. In addition, since no protection covers for the gaskets 30A and 30B are required, an increase in the number of parts or costs is unlikely.

Moreover, protection walls 21*b* are provided in the sub-connectors 20A and 20B, sealing the inlets of the accommodating rooms 11A and 11B to protect the gaskets 30A and 30B from contamination by dirt and dust from without, in a state where the sub-connectors 20A and 20B are fitted into the accommodating rooms 11A and 11B. Hence, the waterproof property of the gaskets 30A and 30B can be improved.

Further, the protection walls 21*b* can prevent the gaskets 30A and 30B from moving, and therefore, reliability of engagement of the gaskets 30A and 30B is improved. In addition, since the protection walls 21*b* are formed integrally with the sub-connectors 20A and 20B, no gasket caps need to be added, and an increase in the number of parts can be avoided.

Yet further, the locking frames 15 are provided on the frame 10, projecting further than the frame end portion 10*a*, for locking the frame 10 and the sub-connectors 20A and 20B to each other, and the locking frames 15 can be bent in the direction B perpendicular to the direction A in which the sub-connectors 20A and 20B are inserted into the frame 10. Therefore, an unlocking operation can be performed easily, and maintenance and disassembly can be done more easily.

Furthermore, the locking projections 25 on the side of the sub-connectors 20A and 20B are provided on the rear side of the waterproof rubber stoppers 48A and 48B of the sub-connectors 20A and 20B to be inserted to the rear ends of the terminal accommodating rooms 24. Therefore, the shape of areas surrounding the locking projections 25 can be designed freely without any limits by the areas where the waterproof rubber stoppers 48A and 48B are fitted.

What is claimed is:

1. A waterproof connector, comprising:

a frame including a plurality of accommodating rooms;

plurality of sub-connectors to be accommodated in the accommodating rooms, respectively; and a plurality of gaskets for sealing gaps between the sub-connectors and the accommodating rooms;

wherein each of the sub-connectors is configured to house at least one terminal;

wherein the gaskets are fixed to inner walls of the accommodating rooms, and sealing surfaces are provided on outer circumferences of the sub-connectors to obtain sealability by pressing the sealing surfaces against inner circumferences of the gaskets;

wherein protection walls are provided in the sub-connectors for protecting the gaskets by sealing inlets of the accommodating rooms when the sub-connectors are accommodated into the accommodating rooms; and wherein locking portions are provided in the frame and the sub-connectors for locking the frame and the sub-connectors to each other when the sub-connectors are accommodated into the accommodating rooms, and at least one of the locking portions is provided on the side of the frame such that it projects further than an end portion of the frame, and can be bent in a direction perpendicular to a direction in which the sub-connectors are inserted into the frame.

2. The waterproof connector according to claim 1, wherein engagement projections are provided in either the gaskets or the inner walls of the accommodating rooms, engagement holes are provided in opposite gaskets or inner walls of the accommodating rooms, and the gaskets are fixed to the inner walls of the accommodating rooms by allowing the engagement projections to be engaged with the engagement holes.

3. The waterproof connector according to claim 1, wherein at least one of the locking portions is provided on the side of each of the sub-connectors adjacent to waterproof rubber stoppers inserted into rear ends of terminal accommodating rooms of the respective sub-connector.

* * * * *